US010395634B2

(12) United States Patent
Walther et al.

(10) Patent No.: US 10,395,634 B2
(45) Date of Patent: Aug. 27, 2019

(54) SPEECH REPRODUCTION DEVICE CONFIGURED FOR MASKING REPRODUCED SPEECH IN A MASKED SPEECH ZONE

(71) Applicant: Fraunhofer-Gesellschaft zur Föderung der angewandten Forschung e.V., München (DE)

(72) Inventors: Andreas Walther, Feucht (DE); Martin Schneider, Erlangen (DE); Emanuel Habets, Spardorf (DE); Oliver Hellmuth, Budenhof (DE)

(73) Assignee: Fraunhofer-Gesellschaft zur Förderung der angewandten Forschung e.V. (DE)

( * ) Notice: Subject to any disclaimer, the term of this patent is extended or adjusted under 35 U.S.C. 154(b) by 0 days.

(21) Appl. No.: 15/651,922

(22) Filed: Jul. 17, 2017

(65) Prior Publication Data

US 2017/0316773 A1 Nov. 2, 2017

Related U.S. Application Data

(63) Continuation of application No. PCT/EP2016/050515, filed on Jan. 13, 2016.

(30) Foreign Application Priority Data

Jan. 20, 2015 (EP) ..... 15151843

(51) Int. Cl.
*G10K 11/175* (2006.01)
*G10K 11/178* (2006.01)
*G10L 21/0216* (2013.01)

(52) U.S. Cl.
CPC ..... *G10K 11/178* (2013.01); *G10K 11/175* (2013.01); *G10K 2210/103* (2013.01);
(Continued)

(58) Field of Classification Search
USPC ..... 381/71.1, 71.9, 71.14, 73.1, 58, 80, 83, 381/119
See application file for complete search history.

(56) References Cited

U.S. PATENT DOCUMENTS 4,052,720 A 10/1977 McGregor et al.
4,059,726 A 11/1977 Watters et al.
(Continued)

FOREIGN PATENT DOCUMENTS

JP H02 230899 A 9/1990
JP 1993-022391 A 1/1993
(Continued)

OTHER PUBLICATIONS

Chatterblocker software: http://www.chatterblocker.com (printout 1 page).
(Continued)

*Primary Examiner* — Yosef K Laekemariam
(74) *Attorney, Agent, or Firm* — Haynes and Boone, LLP

(57) ABSTRACT

A speech reproduction device for reproducing speech based on a received speech signal so that the reproduced speech is intelligible in a clear speech zone and unintelligible in a masked speech zone includes an audio processing module configured for receiving the speech signal; a set of speech loudspeakers configured for reproducing the speech based on one or more speech loudspeaker signals; and a set of masking sound loudspeakers configured for producing a masking sound based on one or more masking sound loudspeaker signals, wherein the masking sound masks the speech in the masked speech zone; wherein the audio processing module includes a speech signal analysis module configured for producing one or more analysis signals based on spectral and/or temporal characteristics of the speech signal; wherein the audio processing module includes a masking sound generator configured for producing one or
(Continued)

more masking sound signals based on the one or more analysis signals.

24 Claims, 4 Drawing Sheets

(52) U.S. Cl.
CPC ..... *G10K 2210/111* (2013.01); *G10K 2210/3049* (2013.01); *G10K 2210/509* (2013.01); *G10L 2021/02166* (2013.01)

(56) References Cited

U.S. PATENT DOCUMENTS

| | | | | |
|---|---|---|---|---|
| 4,438,526 | A | 3/1984 | Thomalla | |
| 7,376,557 | B2 | 5/2008 | Specht et al. | |
| 7,460,675 | B2 | 12/2008 | L'Esperance et al. | |
| 7,548,854 | B2 * | 6/2009 | Roy | H04R 27/00 381/73.1 |
| 9,747,890 | B2 * | 8/2017 | Sidi | G10L 15/01 |
| 2003/0103632 | A1 | 6/2003 | Goubran et al. | |
| 2009/0171670 | A1 | 7/2009 | Bailey et al. | |
| 2011/0182438 | A1 | 7/2011 | Koike et al. | |
| 2013/0185061 | A1 | 7/2013 | Arvanaghi et al. | |
| 2013/0259254 | A1 | 10/2013 | Xiang et al. | |

FOREIGN PATENT DOCUMENTS

| | | | | |
|---|---|---|---|---|
| JP | 3377220 | B2 | 1/1993 | |
| JP | 5011780 | A | 2/2003 | |
| JP | 2007-304446 | | 11/2007 | |
| JP | 2008-245203 | | 10/2008 | |
| JP | 2011-211266 | | 10/2011 | |
| JP | 2012-093705 | | 5/2012 | |
| JP | 2012-095262 | | 5/2012 | |
| JP | 2014-102308 | | 6/2014 | |
| JP | 2014-520284 | | 8/2014 | |
| RU | 2011106029 | A | 8/2012 | |
| WO | WO 2009/156928 | A1 | 12/2009 | |
| WO | WO2010007563 | A2 | 1/2010 | |
| WO | WO 2013/132393 | * | 9/2013 | G01S 5/30 |

OTHER PUBLICATIONS

Stephen J. Elliott and Philip A. Nelson: Active noise control. In: Signal Processing Magazine, IEEE, 10(4): 12-35, 1993 (24 pages).
Office Action dated Jul. 10, 2018 in the parallel Korean patent application No. 10-2017-7023050 (10 pages).
Decision on Grant dated Jul. 6, 2018 for the parallel Russian patent application 2017129381 (24 pages).
Office Action dated Sep. 4, 2018 issued in the parallel Japanese patent application No. 2017-555833 (7 pages with English translation).

* cited by examiner

SPEECH REPRODUCTION DEVICE CONFIGURED FOR MASKING REPRODUCED SPEECH IN A MASKED SPEECH ZONE

CROSS-REFERENCE TO RELATED APPLICATIONS

This application is a continuation of copending International Application No. PCT/EP2016/050515, filed Jan. 13, 2016, which is incorporated herein by reference in its entirety, and additionally claims priority from European Application No. EP 15151843.8, filed Jan. 20, 2015, which is incorporated herein by reference in its entirety.

The present invention relates to speech reproduction and masking of reproduced speech. Different situations suggest the application of speech masking three examples are given in the following:

1. Shared office spaces, where each employee can potentially be distracted from their assigned task, when comprehending conversations of others disregarding if those are conducted via telephone or directly. In such cases a speech masking system can increase the working comfort by inhibiting speech comprehension. Furthermore, there can be a need to keep the content of conversations confidential (i. e., increase speech privacy) where a speech masking system can obviously help to accomplish this.

2. In-car scenarios where a person is in a potentially confidential conversation, while having a designated driver in the vehicle cabin without a physical barrier in between. In this case, the primary goal would be to keep the conversation confidential, while the comfort of the driver is less important, as long as he is not distracted.

3. In a doctor's office, there are often devices allowing for a hands-free communication with the receptionist. In urgent cases: it might be useful for the receptionist to mention details about a patient using that device while another patient is attending. In that case, a speech masking system can be used to ensure confidentiality. Attending patients might accept this masking as they expect absolute confidentiality from the doctor themselves.

BACKGROUND OF THE INVENTION

Speech masking systems that are used to increase working comfort are well known in the art. However, such systems are inefficient to provide speech privacy. Most of the known systems are primarily intended to increase the working comfort, but speech privacy is considered as being secondary.

When only considering the acoustic scene reproduced by a telecommunication device, the reproduction can also be restricted to the clear speech zone by means of beamforming or multi zone reproductions. However, beside the effort through the high number of loudspeakers that may be used, such system will never achieve speech privacy at a sufficient level, since the achieved absolute sound pressure level in the masked speech zone is still well above the hearing threshold of humans. The same holds for active noise cancellation/control approaches, which could potentially not only cancel any signal reproduced but also local human speakers. Moreover, those techniques involve the use of possibly multiple microphones and the adaptive filtering that may be used is a task known to be challenging (Stephen J. Elliott and Philip A. Nelson: Active noise control. In: Signal Processing Magazine, IEEE, 10(4): 12-35, 1993). Eventually, active noise control has only been successfully used for low-frequency sound sources or simple scenarios like ventilation ducts (Stephen J. Elliott and Philip A. Nelson: Active noise control. In: Signal Processing Magazine, IEEE, 10(4): 12-35, 1993).

A widely used method is to generate a masking sound (masker) that cannot be distinguished (i.e. perceptually separated) from the speech (maskee) such that comprehension of the speech is inhibited in presence of the masking sound. Often the term sound masking is used for such systems, since usually some kind of masker sound is played back in a specified area. An approach is to reproduce air-condition-like background noise. This noise overlays the speech and helps to render it unintelligible. While such masking could be achieved by playing back very loud masking sounds, sound masking techniques intend to use a decent masker at a sound level as low as possible.

Often a white noise or a pink noise is used, which at low playback levels is not very effective for masking speech to such a degree that speech privacy can be achieved. Previously proposed methods to enhance the masking effect of induced noise are summarized in the following.

In Bill G. Watters, Michael Nacey and Thomas R. Horrall: Process and apparatus for speech privacy improvement through incoherent masking noise sound generation in open-plan office spaces and the like. U.S. Pat. No. 4,059,726, 1977, incorporated by reference herein, the authors cite from literature that sounds with an unobtrusive character and frequency spectrum, such as wind or wave sounds are suited to achieve speech privacy. This document also states that a sound is more intrusive if the place of its origin can be localized by the listener. A uniform unlocalizable distribution of the masking noise has been found to be advantageous in some scenarios. Therefore, Bill G. Watters, Michael Nacey and Thomas R. Horrall: Process and apparatus for speech privacy improvement through incoherent masking noise sound generation in open-plan office spaces and the like. U.S. Pat. No. 4,059,726, 1977, incorporated by reference herein, proposes the use of multiple decorrelated noise sources to generate a diffuse, uniform, delocalized sound space.

It has been found to be advantageous if the level of the masking sound varies adaptively corresponding to e.g. the surrounding environment characteristics, or the level of the speaker's voice that should be masked (see e.g., Jeffrey Specht, Daniel Mapes-Riordan, and William DeKruif: Method and apparatus of overlapping and summing speech for an output that disrupts speech. U.S. Pat. No. 7,376,557, 2008, incorporated by reference herein; and Andre L. Esperance and Alex Boudreau: Auto-adjusting sound masking system and method. U.S. Pat. No. 7,460,675, 2008, incorporated by reference herein. Also the automatic adaption of the masker's spectral characteristics in addition to level adaption is known to be beneficial (see e.g. Richard O. Thomalla: Automatic volume and frequency controlled sound masking system. U.S. Pat. No. 4,438,526, 1984, incorporated by reference herein and Andre L. Esperance and Alex Boudreau: Auto-adjusting sound masking system and method. U.S. Pat. No. 7,460,675, 2008, incorporated by reference herein. Rafik Goubran and Radamis Botros: Adaptive sound masking system and method. United States Patent Application No.: US 2003/0103632, 2003, incorporated by reference herein, proposes in this respect: "An adaptive sound masking system and method portions undesired sound into time-blocks and estimates frequency spectrum and power level, and continuously generates white noise with a matching spectrum and power level to mask the undesired sound."

Other applications generate specific noise shapes that have the ability to mask speech specifically good (Kenneth P. Roy, Thomas J. Johnson, Ronald Fuller and Steve Dove: Architectural sound enhancement with pre-filtered masking sound. U.S. Pat. No. 7,548,854, 2009, incorporated by reference herein), or produce masking noise that "closely matches the characteristics of the source (person speaking)" (Jeffrey Specht, Daniel Mapes-Riordan, and William DeKruif: Method and apparatus of overlapping and summing speech for an output that disrupts speech. U.S. Pat. No. 7,376,557, 2008, incorporated by reference herein). The latter methods, with the specific aim of rendering speech unintelligible, have been proposed using a masking sound that closely resembles speech utterances by either artificially generating alike sounds, or playing back random concatenations of utterances from a database (see e.g. Jeffrey Specht, Daniel Mapes-Riordan, and William DeKruif: Method and apparatus of overlapping and summing speech for an output that disrupts speech. U.S. Pat. No. 7,376,557, 2008, incorporated by reference herein and Babak Arvanaghi and Joel Fechter: Method and apparatus for masking speech in a private environment. United States Patent Application No.: US 2013/0185061, 2013, incorporated by reference herein. Jeffrey Specht, Daniel Mapes-Riordan, and William DeKruif: Method and apparatus of overlapping and summing speech for an output that disrupts speech. U.S. Pat. No. 7,376,557, 2008, incorporated by reference herein, uses speech sounds to make the masking sound unobtrusive. However, this may still be distracting e.g. for a driver who is exposed to that sound.

Other methods that have been proposed to achieve speech privacy are e.g. the generation of cancelation signals that try to eliminate the target speech at an intended location. Japanese patent application Nakamura Ikuya and Ogiwara Takashi: Speech privacy protective device. Japanese Patent Applications Nos.: JP 3377220 and JP 5011780, 1991 discloses such a speech privacy protection device for vehicle cabins. The conversation is captured, and a cancelation sound is fed to the position where the conversation should not be heard.

Depending on the application, often the masking noise is reproduced either in a large area around the talker, or produced near the talker itself (see Jeffrey Specht, Daniel Mapes-Riordan, and William DeKruif: Method and apparatus of overlapping and summing speech for an output that disrupts speech. U.S. Pat. No. 7,376,557, 2008, incorporated by reference herein, and Robert Bailey, Lawrence Heyl, and Stephan Schell: Systems and methods for altering speech during cellular phone use. United States Patent Application No.: US 2009/0171670, 2009, incorporated by reference herein), or the zones are (additionally) separated by physical means (Mai Koike, Yasushi Shimizu, Masato Hata and Takashi Yamakawa: Masker sound generation apparatus and program. United States Patent Application No.: US 2011/0182438 A1, 2011, incorporated by reference herein). Chatter Blocker (see www.chatterblocker.com) is an application with masking sounds from different categories (sound effects, music chatter voice) which can be played individually or combined, and adjusted in level by the user. It uses the built-in loudspeaker of the playback device (e.g. a tablet), or external loudspeakers connected to the playback device.

SUMMARY

According to an embodiment, a speech reproduction device for reproducing speech based on a received speech signal so that the reproduced speech is intelligible in a clear speech zone and unintelligible in a masked speech zone may have: an audio processing module configured for receiving the speech signal; a set of speech loudspeakers configured for reproducing the speech based on one or more speech loudspeaker signals; and a set of masking sound loudspeakers configured for producing a masking sound based on one or more masking sound loudspeaker signals, wherein the masking sound masks the speech in the masked speech zone; wherein the audio processing module includes a speech loudspeaker signal producer configured for producing the one or more speech loudspeaker signals based on the speech signal; wherein the audio processing module includes a speech signal analysis module configured for producing one or more analysis signals based on spectral and/or temporal characteristics of the speech signal; wherein the audio processing module includes a masking sound generator configured for producing one or more masking sound signals based on the one or more analysis signals; and wherein the audio processing module includes a masking sound loudspeaker signal producer configured for producing the one or more masking sound loudspeaker signals based on the one or more masking sound signals.

According to another embodiment, a method for reproducing speech based on a received speech signal so that the reproduced speech is intelligible in a clear speech zone and unintelligible in a masked speech zone may have the steps of: receiving the speech signal using an audio processing module; reproducing the speech based on one or more speech loudspeaker signals using a set of speech loudspeakers; producing a masking sound based on one or more masking sound loudspeaker signals using a set of masking sound loudspeakers, wherein the masking sound masks the speech in the masked speech zone; producing the one or more speech loudspeaker signals based on the speech signal using a speech loudspeaker signal producer of the audio processing module; producing one or more analysis signals based on spectral and/or temporal characteristics of the speech signal using a speech signal analysis module of the audio processing module; producing one or more masking sound signals based on the one or more analysis signals using a masking sound generator of the audio processing module; and producing the one or more masking sound loudspeaker signals based on the one or more masking sound signals using a masking sound loudspeaker signal producer of the audio processing module.

According to another embodiment, a non-transitory digital storage medium may have a computer program stored thereon to perform the inventive method when said computer program is run by a computer.

The term "set of speech loudspeakers" refers to one or more loudspeakers capable of reproducing speech. Analogously, the term "set of masking sound loudspeakers" refers to one or more loudspeakers capable of producing masking sounds. However, in general, the set of speech loudspeakers is separated from the set of masking sound loudspeakers so that a specific loudspeaker belongs either to the set of speech loudspeakers or to the set of masking sound loudspeakers but not to both sets. As a result, the speech loudspeakers may be located in such way that the speech reproduced by the speech loudspeakers is predominantly directed to the clear speech zone, whereas the masking sound loudspeakers may be located in such way that masking sound produced by the speech loudspeakers is predominantly directed to the masked speech zone The invention provides an improved concept for rendering speech unintelligible for an unintended listener or unintended listeners (who may be referred to as eavesdropper (s)), while it remains comprehensible to an intended listener or to intended listeners at a different position.

In the considered scenario, a reproduced speech is intended to be intelligible in a given area, which is referred to as clear speech zone. At the same time, the reproduced speech should be unintelligible in another given area, which is referred to as masked speech zone, where both zones may be located nearby. This is desirable whenever an inevitable eavesdropper needs to stay within the vicinity of an intended listener.

The comprehension of the speech is inhibited by means of a masking sound (masker) that is adaptively generated, depending on the properties of the speech (maskee) reproduced in or close to the clear speech zone. In other words: "maskee" denotes the speech that has to be masked. The masking sound is reproduced in or close to the masked speech zone.

The speech loudspeaker signal producer may comprise a renderer. The same way the masking sound loudspeaker signal producer may comprise a renderer.

In contrast to some related technologies, the target of the concept as described herein is not to mask speech of one or more present talkers, but to mask reproduced speech, which is, for example, reproduced by a hands-free telecommunication device, wherein the reproduced speech is based on a far-end signal received by the hands-free telecommunication device.

The invention aims rather at achieving speech privacy than increasing work comfort of surrounding employees. Speech privacy is given if people who are in the vicinity of a talker (intentionally or unintentionally) cannot grasp the conversation or comprehend the substance. This is especially important for hands-free telephone calls, where the far-end party is potentially not aware of an eavesdropper.

The invention covers an optimal integration of a masking noise generator in a speech reproduction device, such as a telecommunication device. The following aspects are considered:

- Providing the information that may be used to the masking noise generator
- Reproducing the clear speech signal predominantly in the given clear speech zone.
- Reproducing the masking noise predominantly in the given masked speech zone.

In order to provide the information that may be used to the masking noise generator, a received speech signal is directly observed in the speech reproduction device, prior to its reproduction.

According to the invention the masking sound is adapted to the incoming speech signal. In order to achieve that, the speech signal is directly analyzed by a speech signal analyzers module before the speech signal is converted to speech using speech loudspeakers. In contrast to that, conventional-technology solutions convert the speech, using a microphone, into a signal which then is analyzed.

The invention provides an improvement of the adaptation of the masking sound to the reproduced speech. One reason for this is that a pro-active adaption of the masking sound is possible as, in terms of time, analyzing of the incoming speech signal can be done before the speech eventually is produced. In contrast to that, conventional-technology solutions using the signal from a microphone for analyzing the reproduced speech only a post-active adaptation of the masking sound is possible. As a result a masking sound having a low loudness and a low obtrusiveness may be produced in order to render the speech unintelligible in the masked speech zone.

Regarding the distinction of the terms "unnoticeable" and "unobtrusive", the following may be noted: In conventional-technology speech masking systems, the term "unobtrusive" could also be interpreted as "unnoticeable". I.e. the listener will get used to the uniform masker, and ignore it after some time. In our case, the masker is so obvious that it cannot be ignored, therefore it is not "unnoticeable", but it still can be "unobtrusive" in the sense of "pleasant and not distracting".

The masking may be accomplished in a way that is unobtrusive and pleasant for the intended listener and also such that the eavesdropper is not distracted from any task assigned to him. Hence, it is a further advantage of the present invention that generation of such an unobtrusive, yet effective masking sound is possible.

Producing a localizable masking sound is in the case of the proposed concept not critical as long as the eavesdropper is not distracted from his main task. The masking sound does not have to go "unnoted", and need not permanently be ON (i.e.: if no confidential conversation is held, the masking sound can be turned OFF). The eavesdropper is well aware of the fact that when a phone-call or conversation is made (and only then), he will hear a masking sound, which is used to conceal the conversation.

As a result, as long as, both, the intended listener and the eavesdropper accept the existence of means for masking the conversation, both will accept such a noticeable masking sound.

The speech masking according to the invention does not suffer from the aforementioned limitations of noise cancellation systems, as it does not rely on the exact cancellation of sound waves, wherein masking could be achieved by playing back very loud masking sounds. Instead, it aims at inhibiting human speech recognition, which relies on the tonal, spectral, and transient structure of a speech signal. Typically, a masking sound will also exhibit a tonal, spectral, or transient structure (or combinations thereof). The masker can be generated in a way such that its superposition with the maskee at the eavesdropper's position results in an equalized signal, where the distinguishable speech features are removed. On the other hand, it is also possible to use a masker such that the superposition exhibits distinguishable speech features with the masking sound features obscuring the speech's features to a sufficient extend. The latter approach allows for some degrees of freedom in the choice of the masking signals and is furthermore easier to achieve. In both cases a decent masking sound at a low sound level is possible.

The invention provides a concept for rendering speech unintelligible by using an unobtrusive masking sound that does not distract the eavesdropper from a main task he has to perform (e.g. a driver has to concentrate on driving. Indeed, listening to a nice masker sound could even be less distracting than listening to the conversation! Such, the system helps improving the traffic safety.).

A car environment is an advantageous application-scenario. In this scenario, we have good knowledge about the specific conditions in the car interior (e.g. spatial position of the intended listener, the eavesdropper the loudspeakers, acoustics of the reproduction space, etc. . . . ). Such, we can adapt the different processing steps accordingly. That is an advantage compared to general purpose masking systems.

Taking a car environment as an example, it is important that the driver (=eavesdropper) is not distracted from driving. Such, a sound stage that is localizable (e.g. in front of the driver) is not hindering at all.

However, the invention is not limited to car environments.

According to an advantageous embodiment of the invention the speech loudspeaker signal producer is configured for producing a plurality of speech loudspeaker signals and for controlling characteristics of each speech loudspeaker signal of the plurality of speech loudspeaker signals independently in order to control spatial cues of the speech. The characteristics of the speech loudspeaker signals to be controlled may, in particular, comprise a level and/or a time delay of each of the speech loudspeaker signals.

According to an advantageous embodiment of the invention the masking sound loudspeaker signal producer is configured for producing a plurality of masking sound loudspeaker signals and for controlling characteristics of each masking sound loudspeaker signal of the plurality of masking sound loudspeaker signals independently in order to control spatial cues of the masking sound. The characteristics of the masking sound loudspeaker signals to be controlled may, in particular, comprise a level and/or a time delay of each of the masking sound loudspeaker signals.

By these features spatial audio reproduction techniques can be used to increase the effect of speech masking systems on the speech loudspeaker side as well as on the masking sound loudspeaker side.

Means of spatial audio reproduction can be used to increase the level of the speech in the clear speech zone and decrease the level of the speech in the masked speech zone at the same time. The same holds for the masking sound vice-versa. Techniques having that effect are

- Beamforming
- Multizone reproduction
- An appropriate placement of the loudspeakers (advantageously close to the listener in each zone).

Using speech loudspeakers as masking sound loudspeakers close to the talker is known from conventional technology but not a good option: In that case, the masking sound would have the highest intensity at the clear speech zone, which is not desired. Therefore, the masking sound loudspeakers being others than the speech loudspeakers may be located near or in the masked speech zone, such that the masking sound is reproduced predominantly at this position.

According to an advantageous embodiment of the invention the masking sound generator comprises a plurality of masking sound sources configured to provide a raw masking sound signal and a plurality of raw masking sound signal adaption modules, wherein each of the raw masking sound signal adaption modules is assigned to one of the masking sound sources, wherein the assigned masking adaption module is configured to adapt the raw masking sound signal of the respective masking sound source based on the analysis signal in order to produce one masking sound signal of the one or more masking sound signals.

This aspect of the invention covers the masking noise generator itself. In this embodiment the masking noise generator differs from conventional technology by using a mix of multiple signal sources to generate the masking sound, where the mixed masking sound may be adapted in real time using parameters gained from analyzing the speech signal.

According to an advantageous embodiment of the invention the at least one masking sound source comprise a music source configured to provide a raw music masking sound signal, wherein the assigned masking adaption module is configured to adapt the raw music masking sound signal based on the analysis signal in order to produce one masking sound signal of the one or more masking sound signals.

According to an advantageous embodiment of the invention the at least one masking sound source comprise a continuous noise source configured to provide a raw continuous noise masking sound signal, wherein the assigned masking adaption module is configured to adapt the raw continuous noise masking sound signal based on the analysis signal in order to produce one masking sound signal of the one or more masking sound signals.

According to an advantageous embodiment of the invention the at least one masking sound source comprise a dynamic noise source configured to provide a raw dynamic noise masking sound signal, wherein the assigned masking adaption module is configured to adapt the raw dynamic noise masking sound signal based on the analysis signal in order to produce one of the one or more masking sound signals.

By this means, the masking sound may be generated such that it masks the speech, and at the same time is perceived as being non-distracting, indeed maybe even being perceived as relaxing. The advantage of the inventive concept over the state of the art is that the masking sound may be produced by the use of a plurality of different masking sound signals with different characteristics, which may be automatically adapted in real-time to the present situation. Due to the different characteristics of the plurality of masking sound signals, each one may be applied to achieve a specific goal, those could be e.g.: sea shore sound to achieve basic masking effect, filtered noise quickly adapting to the speech signal to mask important parts of the speech, and music to ensure that the masking sound is not annoying). The individual adaption of the masking sound signals to the present situation allows to instantly react on changes in the speech (e.g. fast adoption of the noise masking sound signal), while the masking sound is not perceived as being unsteady (e.g. the music masking sound signal will adopt with much slower time constants, and within a restricted range).

Since different speech features are most effectively destroyed by accordingly different types of noise, the inventive concept is more effective than the state of the art. When trading a share of this effectivity, it is possible to produce a less obtrusive masking sound. The following aspects are considered by this invention:

- Determining a mix of suitable masking signals.
- Obtaining or generating such signals.
- Obtaining information or use prediction to determine the parameters for the mix.
- Adapting the masking signals.

There is a tendency that more effective masking signals are also more obtrusive. The same holds for fast changes in the properties of the masking signal. The following types of sounds are advantageously used in the invention:

- Random noise is well-known from conventional technology and constitutes one source signal of the invention among others. As known from conventional technology the spectral envelope of this signal can be shaped to optimize its masking capabilities. It is known that this signal is very effective in masking, while it is also perceived as being obtrusive.
- Natural noises are sounds of acoustic scenes that can be perceived at real-world places. This includes, but is not limited to, sea shores, waterfalls, streets, places near vehicle engines, crowds of people and restaurants. Since those noises are known to humans, they are likely to be perceived less obtrusive than random noise. Still, since the properties of those noises are often not stationary, their masking ability varies in time.

Music signals are generally perceived as being pleasant, while their masking capabilities are rather low. Additionally, they may only slowly be altered (e. g. in level) to retain their pleasant perception. Finally, music signals are also non-stationary, which imposes the same problems as for natural noises. However, in combination with some noise (natural or random), this is effective.

The signal types mentioned above can be obtained by the raw masking sound signal adaption modules in the following ways:

- Read from a recording, where the signals are given, while their properties are known in advance. The latter fact can be used to optimize the adaptation later.
- Artificially generated by the modules. In the case of random noise signals, this would be typically pseudo-random noise. In the case of natural noises, the properties of the noises can be defined. This overcomes the limitations imposed by the uncontrollable (non-stationarity) of recorded signals. Such a "natural" noise generator can make use of external data source to better fit in a given scenario. E. g. it is possible to consider the engine speed in an in-car scenario to mimic perfectly fitting engine noise.
- Measured by a microphone in real time (e. g. for amplifying car noise).
- The generation of a pleasant masking noise (e.g. waves-like, wind-like) can be done in real-time by a sound-generator that is specifically tailored to mask speech. Additionally, it can adapt to the characteristics of different speakers and conversational styles (by shaping its spectrum by spectral shift and/or gain).
- The same applies for the music, which could also be automatically composed in real-time by adequate algorithms.
- Alternatively, prerecorded music and noise can be used (short loops may probably be enough).

All signals that are mixed in the masking sound may be adapted individually, depending on the speech to be masked. There may be parameters defined during development that represent the effectiveness and obtrusiveness of the individual masking signal which are then combined to a cost function for optimization. An important aspect is that the intended listener not be irritated by the masking noise. To some degree, this is already achieved by adapting the masking sound dynamically to the speech, since the clear speech will dominate at the intended listener positions, while the activity of the clear speech and the masking sound will be strongly correlated.

Means to adapt the masker signal such that it best possibly masks the received speech signal include:

- Recognition of the tonal structure of the maskee can be inhibited by the following properties of the masker: A tonal structure unlike the tonal structure of the maskee. This structure can be random (e. g. musical noise) or determined (e. g. a music recording).
- Recognition of the spectral structure can be inhibited by the following properties of the masking sound: Filling the spectral gaps in the superpositions of the masking sound and the sound to be masked such that an unimodal or flat spectrum is perceived as well as having a pronounced spatial structure such that the spectral structure of the maskee is obscured.
- Recognition of the transient structure can be inhibited by the following properties of the masking sound: Having a transient structure that is different from the maskee; the occurrence frequency of transients in the masker can be adapted to the maskee, while the actual triggering of an occurrence is independent of the maskee; producing random transient structure in the masker to further confuse the eavesdropper.

According to an advantageous embodiment of the invention the audio processing module comprises an adaptive speech processing module configured to provide an adapted speech signal based on the speech signal, wherein the speech loudspeaker signal producer is configured to produce the one or more speech loudspeaker signals based on the adapted speech signal.

With an extended access within the speech reproduction device, the maskee (clear speech signal) can be modified to ease its masking. Measures to achieve this include:

- A band limitation to frequencies that can be sufficiently masked.
- A delay such that the masking noise generator has more time to adapt the masking noise accordingly. Moreover, such a delay allows adapting the masking noise even before reproduction of the signal to be masked. This is a way forward masking effects known from psychoacoustics can be exploited. However, such a delay would have to be short enough such that it is not perceived by the communicating parties.
- A manipulation/damping/suppression of transients in the clean speech signal, which are particularly difficult to mask. This measure has to be used carefully, in order not to degrade intelligibility for the intended listener.
- A reduction of the variation in level, e. g., by means of a dynamics processor (e.g. a compressor). This would also reduce the variation of an optimal masking sound such that this sound becomes more pleasant.

According to an advantageous embodiment of the invention the audio processing module is configured to receive a setup signal containing information regarding a setup of the set of speech loudspeakers and/or the setup of the set of masking sound loudspeakers.

By these features the audio processing module may easily be adapted to different loudspeaker configurations. The setup signal may be used by the speech loudspeaker signal producer, by the masking sound loudspeaker signal producer and/or by the masking sound generator, in particular by the raw masking sound signal adaption modules.

The masking sound may not only be adapted in real time using parameters gained from analyzing the speech signal. Instead, further sources of information, as mentioned below, may be used.

The main source of information for adapting the masker is the signal to be masked (the maskee). This can be accompanied by measured signals. Due to causality, only previous and current signal properties can be directly considered. However, it is known from speech coding that the spectral envelope can be predicted to a certain extend for a time span of a few ten milliseconds. Such a prediction can be used to adapt the masking sound to the anticipated properties of the sound to be masked. This would also allow for adapting the masking sound more slowly/smoothly such it is perceived as being more pleasant. Note that, this is an alternative to delaying the reproduced clear speech.

A second source of information may be user-set parameters, such that it is possible to adjust the degree of masking. If only a slight degree of privacy is desired, the masking sound can be chosen to be very unobtrusive. On the other hand, if the speech content is confidential, and it has to be assured that not a single word can be understood by the eavesdropper, the processing can adapt to that. Both, the intended listener and the eavesdropper, would have to accept the more intrusive masker in that case.

Furthermore, the eavesdropper could be allowed to have limited access to the sound processing device, such that he can tailor the masking sound to his preferences (e.g. he could choose between different masking-music). Important is that during the applied changes, there be no period where the speech is comprehensible. Therefore, all music used would have to be pre-selected, since not every piece of music/musical style is suitable to be used for effectively masking speech.

According to an advantageous embodiment of the invention the masking sound generator is configured to receive a weather signal containing information regarding weather conditions and to produce the one or more masking sound signals based on the weather signal.

The weather sensor may be a rain sensor or a wind speed sensor, which may be used to consider the actual weather for masking noise generation (e.g. using rain-like masking sounds or wind-like masking sounds)

According to an advantageous embodiment of the invention the masking sound generator is configured to receive a light signal containing information regarding light conditions and to produce the one or more masking sound signals based on the light signal.

According to an advantageous embodiment of the invention the masking sound generator is configured to receive a time signal containing information regarding date and/or time and to produce the one or more masking sound signals based on the time signal.

A light signal, in particular a light signal received from a light sensor, may be used to produce a masking sound that naturally fits the surrounding light conditions, which, in particular, depend on the daytime, and is therefore less annoying. The same can be achieved using a time signal, in particular a time signal received from a digital clock.

According to an advantageous embodiment of the invention the masking sound generator is configured to receive an engine signal containing information regarding an operating parameter of a sound producing engine and to produce the one or more masking sound signals based on the engine signal.

In particular in an in-car scenario data gathered from an engine can be used as a parameter for an artificial like noise generation. This concept could also be used in other means of transportation or in cases where stationary engines are close to the device.

According to an advantageous embodiment of the invention the speech reproduction device comprises a tracking device configured for tracking a position and/or orientation of a person in the clear speech zone and/or for tracking a position and/or orientation of a person in the masked speech zone, wherein the tracking device is configured to produce a tracking signal comprising the position and/or orientation of the person in the clear speech zone and/or the position and/or orientation of the person in the masked speech zone, wherein the audio processing module is configured to receive the tracking signal and to produce the one or more masking sound loudspeaker signals based on the tracking signal.

A tracking system can provide information about the positions and orientations of the talker and the eavesdropper in real time. This information, for example, can be used to increase the level of masking when both approach each other or when the eavesdropper turns his head for better hearing.

According to an advantageous embodiment of the invention the masking sound loudspeaker signal producer is configured to produce the masking sound loudspeaker signals in such way that the masking sound has the same spatial cues as the speech in the masked speech zone.

According to an advantageous embodiment of the invention the speech reproduction device comprises one or more microphones assigned to the clear speech zone and/or masked speech zone, wherein each of the microphones produces a microphone signal.

The information gathered by the speech signal analysis module may be supported by signals measured by microphones located in or close to the clear speech zone and/or in all close to the masked speech zone. In our scenario: a microphone could be added in the masked speech zone to change the masker based on the maskee signal observed in the masked speech zone.

According to an advantageous embodiment of the invention at least two microphone signals of the microphone signals are fed to the masking sound loudspeaker signal producer, and wherein the masking sound loudspeaker signal producer is configured to determine the spatial cues of the speech in the masked speech zone based on the at least two microphone signals.

At least two microphones may be positioned in or close to the masked speech zone in order to determine the direction of arrival of the maskee and to control the masking sound loudspeaker signal producer based on this information, for example, such that the maskee and the masker have similar spatial and cues.

By these features the invention can optionally exploit means of spatial reproduction to reproduce the masking sound at the masked speech zone that exhibits similar spatial properties (especially direction of the source and direction of dominant reflections) as the undesired clear speech signal that arrives at the masked speech zone. This prevents eavesdroppers from taking advantage of their spatial hearing to separate the masking sound from the speech to be masked.

According to an advantageous embodiment of the invention at least one microphone signal of the microphone signals is fed to the masking sound generator, wherein the masking sound generator is configured to produce the one or more masking sound signals based on the at least one microphone signal.

In such embodiments a microphone could be added in or close to the masked speech zone to change the masker based on the speech observed in the masked speech zone.

According to an advantageous embodiment of the invention the masking sound generator is configured to produce the one or more masking sound signals based on one or more room impulse responses and/or one or more transfer functions from the set of speech loudspeakers to the clear speech zone, based on one or more room impulse responses and/or one or more transfer functions from the set of masking sounds loudspeakers to the clear speech zone, based on one or more room impulse responses and/or one or more transfer functions from the set of speech loudspeakers to the masked speech zone and/or based on one or more room impulse responses and/or one or more transfer functions from the set of masking sound loudspeakers to the masked speech zone.

An additional microphone can be used to measure the room impulse responses/acoustic transfer functions from the reproduction system for the clean speech and the masking noise to the clear speech zone and the masked speech zone (all four paths) to improve estimates of the actually reproduced acoustic scenes in both zones. Those estimates can be used in the adaptive processing of the masking sound.

In a further aspect the present invention provides a method for reproducing speech based on a received speech signal so that the reproduced speech is intelligible in a clear speech zone and unintelligible in a masked speech zone, the method comprising the steps of:

receiving the speech signal using an audio processing module;

reproducing the speech based on one or more speech loudspeaker signals using a set of speech loudspeakers;

producing a masking sound based on one or more masking sound loudspeaker signals using a set of masking sound loudspeakers, wherein the masking sound masks the speech in the masked speech zone;

producing the one or more speech loudspeaker signals based on the speech signal using a speech loudspeaker signal producer of the audio processing module;

producing one or more analysis signals based on spectral and/or temporal characteristics of the speech signal using a speech signal analysis module of the audio processing module;

producing one or more masking sound signals based on the one or more analysis signals using a masking sound generator of the audio processing module; and producing the one or more masking sound loudspeaker signals based on the one or more masking sound signals using a masking sound loudspeaker signal producer of the audio processing module.

Computer program for, when running on a processor, executing the method according to the invention.

BRIEF DESCRIPTION OF THE DRAWINGS

Embodiments of the present invention will be detailed subsequently referring to the appended drawings, in which.

DETAILED DESCRIPTION OF THE INVENTION

With respect to the devices and the methods of the described embodiments the following shall be mentioned:

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Figure 1:
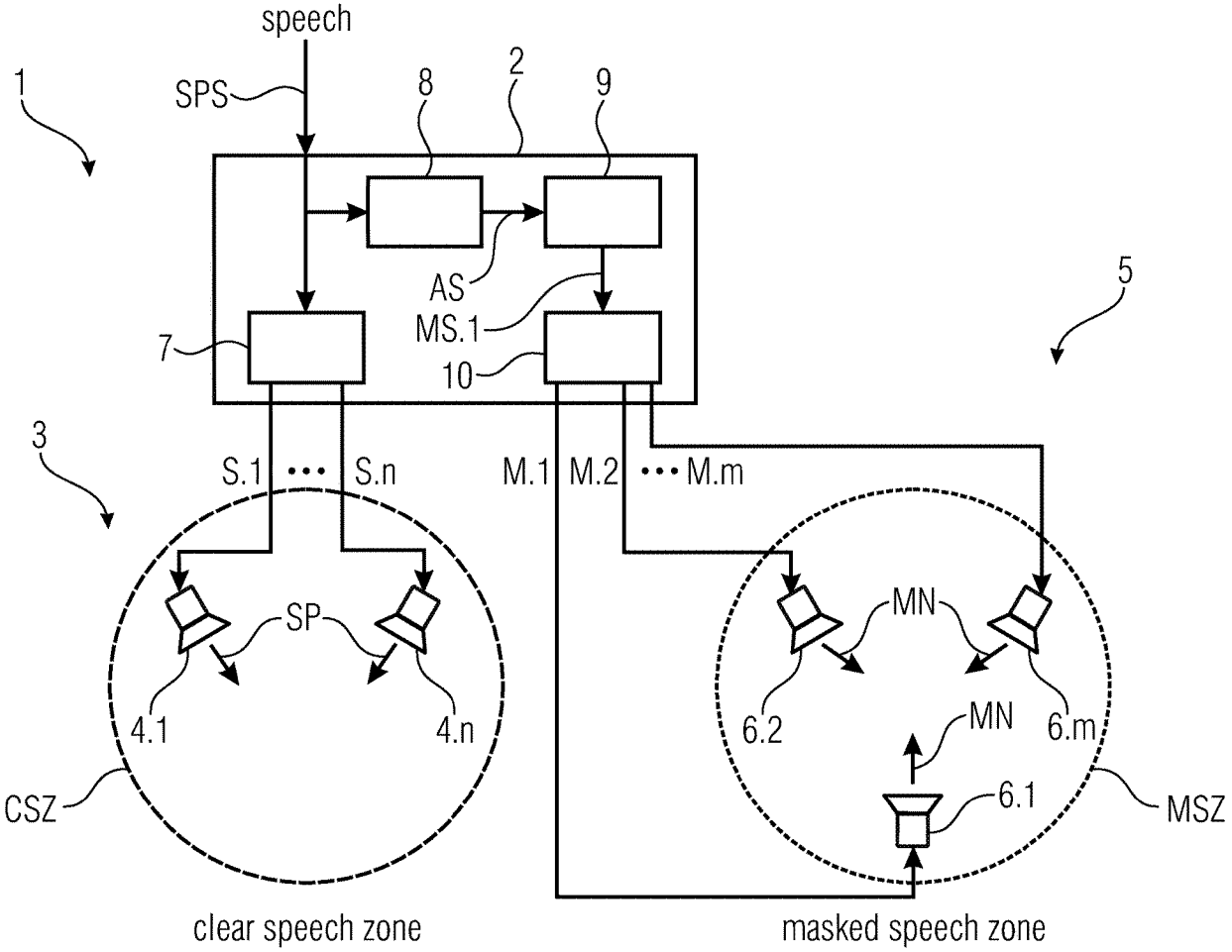
FIG. 1 illustrates a first embodiment of a speech reproducing device according to the invention in a schematic view.

FIG. 1 illustrates a first embodiment of a speech reproducing device 1 according to the invention in a schematic view. The speech reproduction device 1 is configured for reproducing speech SP based on a received speech signal SPS so that the reproduced speech SP is intelligible in a clear speech zone CSZ and unintelligible in a masked speech zone MSZ. The speech reproduction device 1 comprises:

an audio processing module 2 configured for receiving the speech signal SPS;

a set 3 of speech loudspeakers 4 configured for reproducing the speech SP based on one or more speech loudspeaker signals S; and a set 5 of masking sound loudspeakers 6 configured for producing a masking sound MN based on one or more masking sound loudspeaker signals M.1, M.2 . . . M.m, wherein the masking sound MN masks the speech SP in the masked speech zone MSZ;

wherein the audio processing module 2 comprises a speech loudspeaker signal producer 7 configured for producing the one or more speech loudspeaker signals S.1 . . . S.n based on the speech signal SPS;

wherein the audio processing module 2 comprises a speech signal analysis module 8 configured for producing one or more analysis signals AS based on spectral and/or temporal characteristics of the speech signal SPS;

wherein the audio processing module 2 comprises a masking sound generator 9 configured for producing one or more masking sound signals MS.1, MS.2, MS.3, MS.4 based on the one or more analysis signals AS; and wherein the audio processing module 2 comprises a masking sound loudspeaker signal producer 10 configured for producing the one or more masking sound loudspeaker signals M.1, M.2 . . . M.m based on the one or more masking sound signals MS.

According to an advantageous embodiment of the invention the speech loudspeaker signal producer 7 is configured for producing a plurality of speech loudspeaker signals S.1 . . . S.n and for controlling characteristics of each speech loudspeaker signal S.1 . . . S.n of the plurality of speech loudspeaker signals S.1 . . . S.n independently in order to control spatial cues of the speech SP. The characteristics of the speech loudspeaker signals S.1 . . . S.n to be controlled may, in particular, comprise a level and/or a time delay of each of the speech loudspeaker signals S.1 . . . S.n.

According to an advantageous embodiment of the invention the masking sound loudspeaker signal producer 10 is configured for producing a plurality of masking sound loudspeaker signals M.1, M.2 . . . M.m and for controlling characteristics of each masking sound loudspeaker signal M.1, M.2 . . . M.m of the plurality of masking sound loudspeaker signals M.1, M.2 . . . M.m independently in order to control spatial cues of the masking sound MN. The characteristics of the masking sound loudspeaker signals M.1, M.2 . . . M.m to be controlled may, in particular, comprise a level and/or a time delay of each of the masking sound loudspeaker signals M.1, M.2 . . . M.m.

In another aspect the invention provides a method for generating speech SP based on a received speech signal SPS so that the generated speech SP is intelligible in a clear speech zone CSZ and unintelligible in a masked speech zone MSZ, the method comprising the steps of:

receiving the speech signal SPS using an audio processing module 2;

generating the speech SP based on one or more speech loudspeaker signals S.1 . . . S.n using a set 3 of speech loudspeakers 4.1 . . . 4.*n;* generating a masking sound MN based on one or more masking sound loudspeaker signals using a set 5 of masking sound loudspeakers 6.1, 6.2 . . . 6.*m*, wherein the masking sound MN masks the speech SP in the masked speech zone MSZ;

producing the one or more speech loudspeaker signals S.1 . . . S.n based on the speech signal SPS using a speech loudspeaker signal producer 7 of the audio processing module 2;

producing one or more analysis signals AS based on spectral and/or temporal characteristics of the speech signal SPS using a speech signal analysis module 8 of the audio processing module 2;

producing one or more masking sound signals MS.1, MS.2, MS.3, MS.4 based on the one or more analysis signals AS using a masking sound generator 9 of the audio processing module 2; and producing the one or more masking sound loudspeaker signals M.1, M.2 . . . M.m based on the one or more masking sound signals MS.1, MS.2, MS.3, MS.4 using a masking sound loudspeaker signal producer 10 of the audio processing module 2.

In a further aspect the invention provides a computer program for, when running on a processor, executing the method according to the invention.

Figure 2:
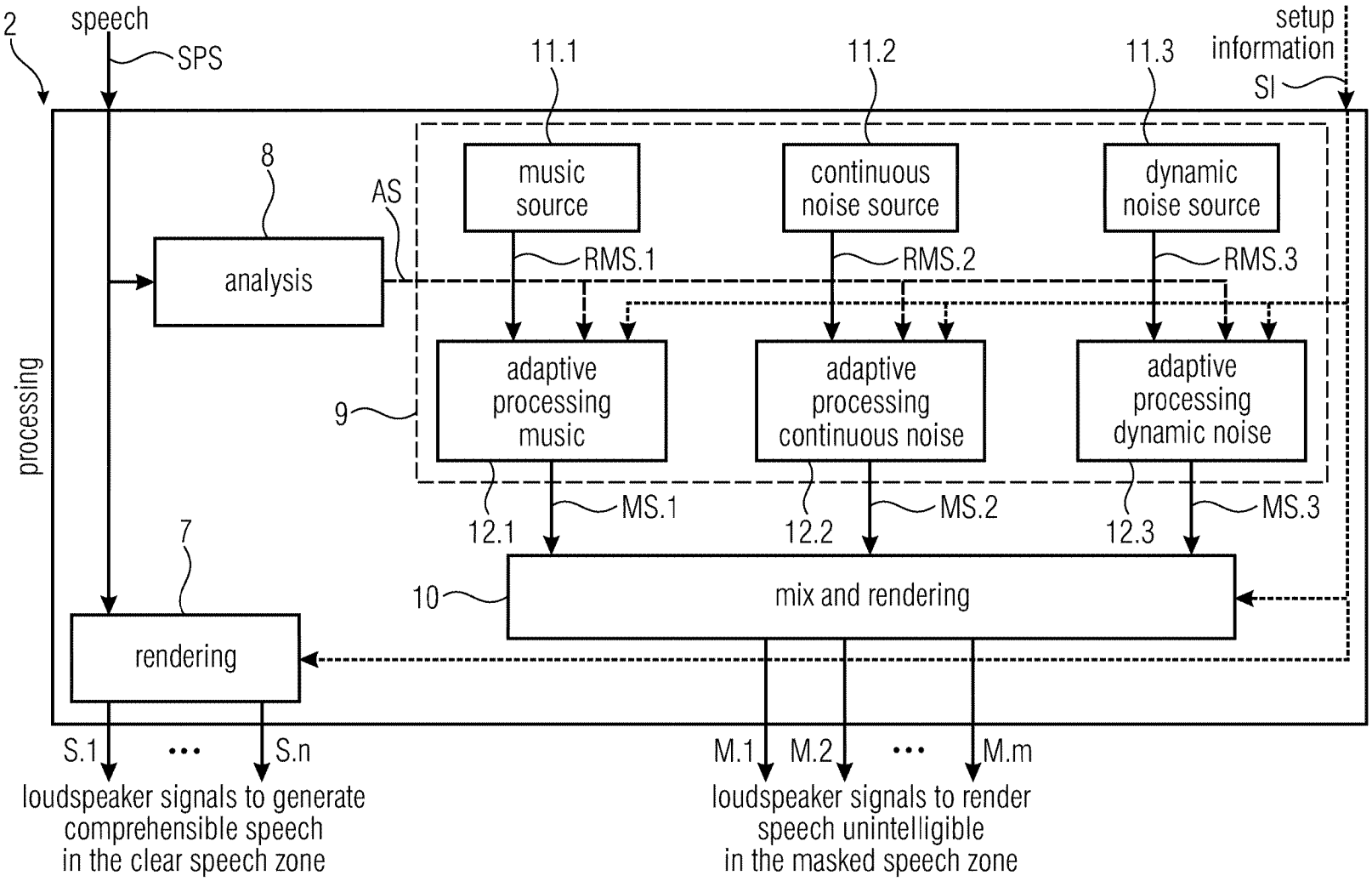
FIG. 2 illustrates a part of a second embodiment of a speech reproducing device according to the invention in a schematic view.

FIG. 2 illustrates a part of a second embodiment of a speech reproducing device according to the invention in a schematic view.

According to an advantageous embodiment of the invention the masking sound generator 9 comprises a plurality of masking sound sources 11.1, 11.2, 11.3, 11.4 configured to provide a raw masking sound signal RMS.1, RMS.2, RMS.3, RMS.4 is and a plurality of raw masking sound signal adaption module 12.1, 12.2, 12.3, 12.4, wherein each of the raw masking sound signal adaption modules 12.1, 12.2, 12.3, 12.4 is assigned to one of the masking sound sources 11.1, 11.2, 11.3, 11.4, wherein the assigned masking adaption module 12.1, 12.2, 12.3, 12.4 is configured to adapt the raw masking sound signal RMS.1, RMS.2, RMS.3, RMS.4 of the respective masking sound sources 11.1, 11.2, 11.3, 11.4 based on the analysis signal AS in order to produce one of the one or more masking sound signals MS.1, MS.2, MS.3, MS.4.

According to an advantageous embodiment of the invention the at least one masking sound source 11.1, 11.2, 11.3, 11.4 comprise a music source 11.1 configured to provide a raw music masking sound signal RMS.1, wherein the assigned masking adaption module 12.1 is configured to adapt the raw music masking sound signal RMS.1 based on the analysis signal AS in order to produce one masking sound signal MS.1 of the one or more masking sound signals MS.1, MS.2, MS.3, MS.4.

According to an advantageous embodiment of the invention the at least one masking sound source 11.1, 11.2, 11.3, 11.4 comprise a continuous noise source 11.2 configured to provide a raw continuous noise masking sound signal RMS.2, wherein the assigned masking adaption module 12.2 is configured to adapt the raw continuous noise masking sound signal RMS.2 based on the analysis signal AS in order to produce one masking sound signal MS.2 of the one or more masking sound signals MS.1, MS.2, MS.3, MS.4.

According to an advantageous embodiment of the invention the at least one masking sound source 11.1, 11.2, 11.3, 11.4 comprise a dynamic noise source 11.3 configured to provide a raw dynamic noise masking sound signal RMS.3, wherein the assigned masking adaption module 12.3 is configured to adapt the raw dynamic noise masking sound signal RMS.3 based on the analysis signal AS in order to produce one masking sound signal MS.3 of the one or more masking sound signals MS.1, MS.2, MS.3, MS.4.

According to an advantageous embodiment of the invention the audio processing module 2 comprises an adaptive speech processing module 13 configured to provide an adapted speech signal ASPS based on the speech signal SPS, wherein the speech loudspeaker signal producer 7 is configured to produce the one or more speech loudspeaker signals S.1 . . . S.n based on the adapted speech signal ASPS.

According to an advantageous embodiment of the invention the audio processing module 2 is configured to receive a setup signal SI containing information regarding a setup of the set 3 of speech loudspeakers 4.1 . . . 4.*n* and/or the setup of the set 5 of masking sound loudspeakers 6.1, 6.2 . . . 6.*m*.

According to FIG. 2 the speech signal SPS to be reproduced is received, as an example, via a telecommunications link and played back via loudspeakers 4.1 . . . 4.*n* in or close to the clean speech zone CSZ at a level such that it can be easily understood. At the same time, the masking sound MN is produced in the masked speech zone MSZ, such that the reproduced speech is not comprehensible by persons within the masked speech zone MSZ.

The processing stage 2 includes a speech signal analysis module 8 for analyzing the incoming speech signal SPS. The analysis result AS is fed to individual adaptive processing blocks 12.1, 12.2, 12.3 for three distinct masking components: music, continuous noise, and dynamic noise. The music and the continuous noise raw masking sounds (e.g. a recording of a sea-shore) may be played back from storage devices 11.1 and 11.2, while the dynamic noise is generated in real-time by a synthesizer 11.3. Depending on the results of the analysis of the present speech section 8, characteristics of the music and noise signals 11.1, 11.2, 11.3 are adapted to provide a good masker MN. The individual processing blocks 12.1, 12.2, 12.3 can output either a mono signal, or to allow for specific multichannel effects, multiple channel signals. The processed music and noise signals MS.1, MS.2, MS.3 are subsequently mixed by the masking sound loudspeaker signal producer 10 to generate sufficient loudspeaker signals M.1, M.2 . . . M.n to feed the available loudspeakers 6.1, 6.2 . . . 6.*m*. The setup information that is known to the adaptive processing, the mixing, and the rendering allows to make best possible use of the given characteristics (e.g. spatial position, frequency characteristic, transducer character, etc.) to achieve the masking effect.

The analysis calculates an estimate of the perceived loudness (could also be purely energy based) of the speech SP. The music signal MS.1 and the noise signals MS.2 and MS.3 are continuously adapted so that their loudness varies in relation to that of the speech SP (the maskee). The processing may use different adaption-constants for all three components. While the dynamic noise quickly adapts to mask fast changes in the speech SP, the continuous noise and the music signal MS.1 and MS.2 adapt with slow variation over time to keep the overall sound impression pleasant. For music and dynamic noise, minimum levels are set, such that they do not fade to zero during speech pauses (and such the loudness of the masking sound goes to zero). This further increases the pleasant perception.

Figure 3:
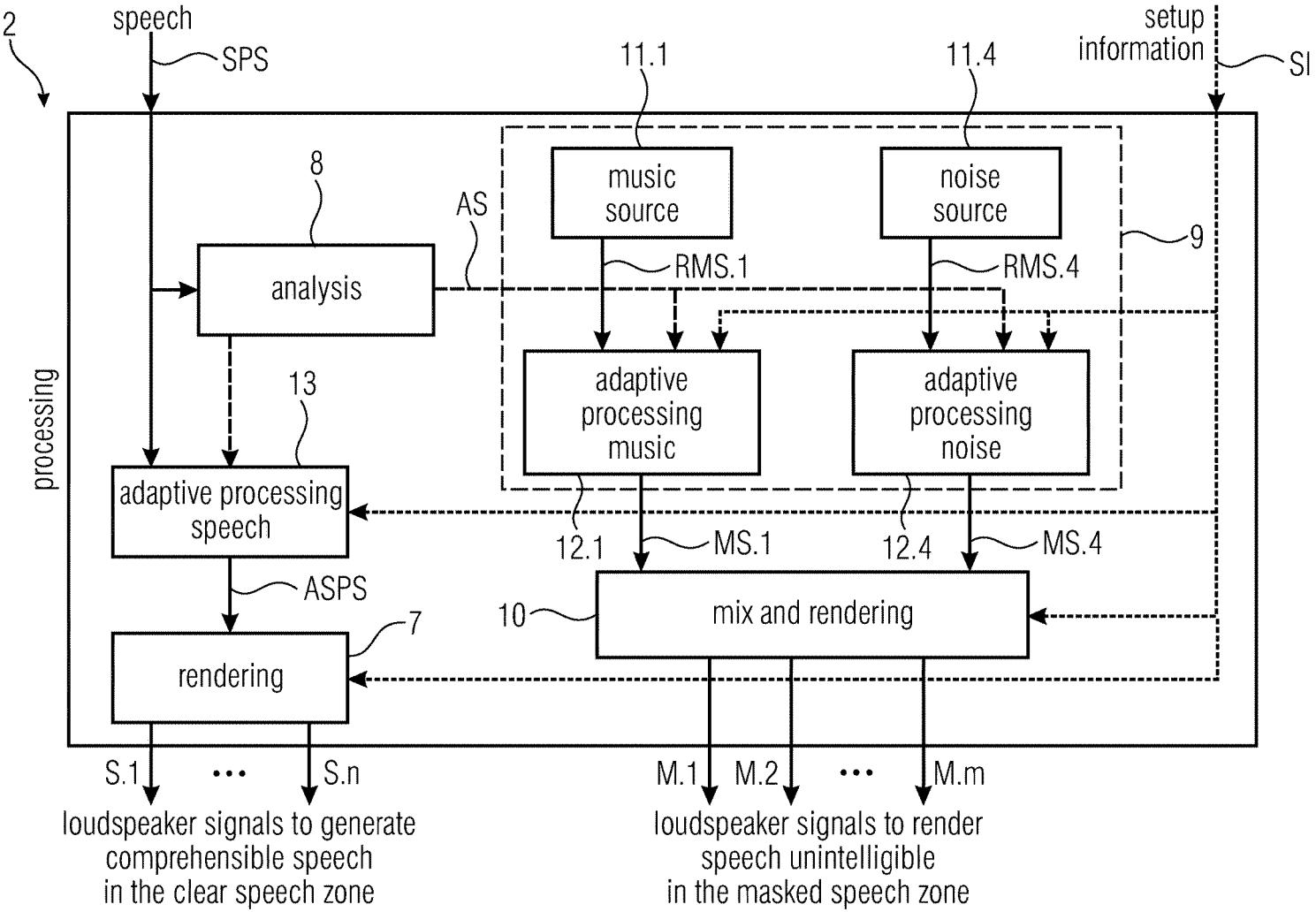
FIG. 3 illustrates a part of third embodiment of a speech reproducing device according to the invention in a schematic view.

FIG. 3 illustrates a part of a third embodiment of a speech reproducing device according to the invention in a schematic view.

A first modification of the embodiment described before is that an additional adaptive processing of the speech signal SPS is done by the adaptive speech processing module 13, wherein an adapted speech signal ASPS is used to produce the speech SP for the clear speech zone CSZ. Furthermore, in this embodiment, only two distinct masking components MS.1, MS.4 (i.e. music and noise) are used.

Figure 4:
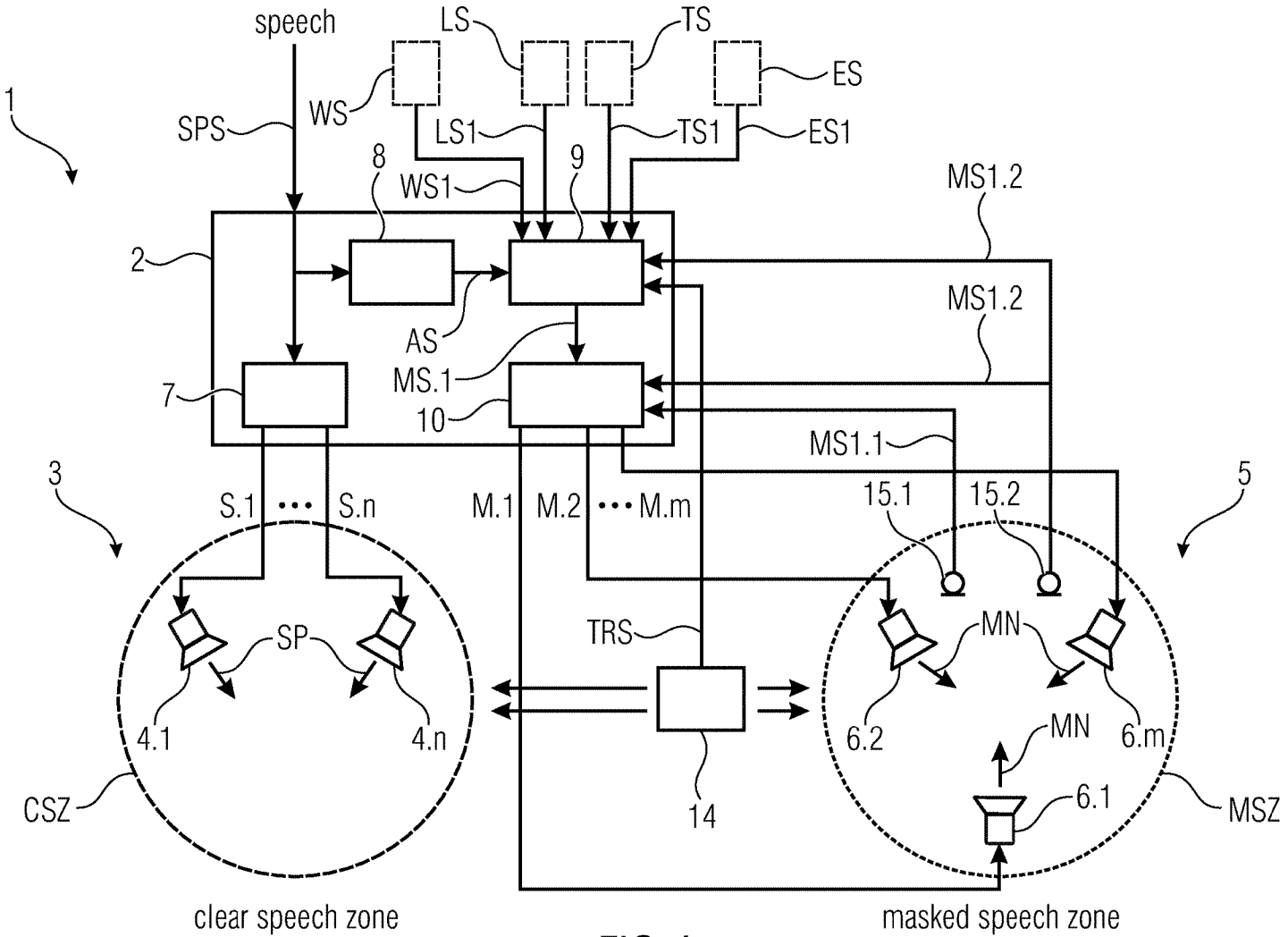
FIG. 4 illustrates a fourth embodiment of a speech reproducing device according to the invention in a schematic view.

FIG. 4 illustrates a fourth embodiment of a speech reproducing device according to the invention in a schematic view.

According to an advantageous embodiment of the invention the masking sound generator 9 is configured to receive a weather signal WSI containing information regarding weather conditions and to produce the one or more masking sound signals MS.1, MS.2, MS.3, MS.4 based on the weather signal WSI.

According to an advantageous embodiment of the invention the masking sound generator 9 is configured to receive a light signal LSI containing information regarding light conditions and to produce the one or more masking sound signals MS.1, MS.2, MS.3, MS.4 based on the light signal LSI.

According to an advantageous embodiment of the invention the masking sound generator 9 is configured to receive a time signal TSI containing information regarding date and/or time and to produce the one or more masking sound signals MS.1, MS.2, MS.3, MS.4 based on the time signal TSI.

According to an advantageous embodiment of the invention the masking sound generator 9 is configured to receive an engine signal ESI containing information regarding an operating parameter of an sound producing engine EG and to produce the one or more masking sound signals MS.1, MS.2, MS.3, MS.4 based on the engine signal ESI.

According to an advantageous embodiment of the invention the speech reproduction device 1 comprises a tracking device 14 configured for tracking a position and/or orientation of a person in the clear speech zone CSZ and/or for tracking a position and/or orientation of a person in the masked speech zone MSZ, wherein the tracking device 14 is configured to produce a tracking signal TRS comprising the position and/or orientation of the person in the clear speech zone CSZ and/or the position and/or orientation of the person in the masked speech zone MSZ, wherein the audio processing module 2 is configured to receive the tracking signal TRS and to produce the one or more masking sound loudspeaker signals M.1, M.2 . . . M.m based on the tracking signal TRS.

According to an advantageous embodiment of the invention the masking sound loudspeaker signal producer 10 is configured to produce the masking sound loudspeaker signals MSI.1, MSI.2 in such way that the masking sound MN has the same spatial cues as the speech SP in the masked speech zone MSZ.

According to an advantageous embodiment of the invention the speech reproduction device 1 comprises one or more microphones 15.1, 15.2 assigned to the masked speech zone MSZ, wherein each of the microphones 15.1, 15.2 produces a microphone signal MSI.1, MSI.2.

According to an advantageous embodiment of the invention at least two microphone signals MSI.1, MSI.2 of the microphone signals MSI.1, MSI.2 are fed to the masking sound loudspeaker signal producer 10, and wherein the masking sound loudspeaker signal producer 10 is configured to determine the spatial cues of the speech SP in the masked speech zone MSZ based on the at least two microphone signals MSI.1, MSI.2.

According to an advantageous embodiment of the invention at least one microphone signal MSI.2 of the microphone signals MSI.1, MSI.2 is fed to the masking sound generator 9, wherein the masking sound generator 9 is configured to produce the one or more masking sound signals MS.1, MS.2, MS.3, MS.4 based on the at least one microphone signal MSI.1, MSI.2.

According to an advantageous embodiment of the invention the masking sound generator 9 is configured to produce the one or more masking sound signals MS.1, MS.2, MS.3, MS.4 based on one or more room impulse responses and/or one or more transfer functions from the set 3 of speech loudspeakers 4.1 . . . 4.*n* to the clear speech zone CSZ, based on one or more room impulse responses and/or one or more transfer functions from the set 5 of masking sounds loudspeakers 6.1, 6.2 . . . 6.*m* to the clear speech zone CSZ, based on one or more room impulse responses and/or one or more transfer functions from the set 3 of speech loudspeakers 4.1 . . . 4.*n* to the masked speech zone MSZ and/or based on one or more room impulse responses and/or one or more transfer functions from the set 5 of masking sound loudspeakers 6.1, 6.2 . . . 6.*m* to the masked speech zone MSZ.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, which is stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may be configured, for example, to be transferred via a data communication connection, for example via the Internet.

A further embodiment comprises a processing means, for example a computer, or a programmable logic device, configured or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention.

It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A speech reproduction device for reproducing speech based on a received speech signal so that the reproduced speech is intelligible in a clear speech zone and unintelligible in a masked speech zone, the speech reproduction device comprising:

an audio processing module configured for receiving the speech signal;

a set of speech loudspeakers configured for reproducing the speech based on one or more speech loudspeaker signals; and a set of masking sound loudspeakers configured for producing a masking sound based on one or more masking sound loudspeaker signals, wherein the masking sound masks the speech in the masked speech zone;

wherein the audio processing module comprises a speech loudspeaker signal producer configured for producing the one or more speech loudspeaker signals based on the speech signal;

wherein the audio processing module comprises a speech signal analysis module configured for producing one or more analysis signals based on spectral and/or temporal characteristics of the speech signal;

wherein the audio processing module comprises a masking sound generator configured for producing one or more masking sound signals based on the one or more analysis signals; and wherein the audio processing module comprises a masking sound loudspeaker signal producer configured for producing the one or more masking sound loudspeaker signals based on the one or more masking sound signals.

2. The speech reproduction device according to claim 1, wherein the speech loudspeaker signal producer is configured for producing a plurality of speech loudspeaker signals and for controlling characteristics of each speech loudspeaker signal of the plurality of speech loudspeaker signals independently in order to control spatial cues of the speech.

3. The speech reproduction device according to claim 1, wherein the masking sound loudspeaker signal producer is configured for producing a plurality of masking sound loudspeaker signals and for controlling characteristics of each masking sound loudspeaker signal of the plurality of masking sound loudspeaker signals independently in order to control spatial cues of the masking sound.

4. The speech reproduction device according to claim 1, wherein the masking sound generator comprises a plurality of masking sound sources configured to provide a raw masking sound signal is and a plurality of raw masking sound signal adaption module, wherein each of the raw masking sound signal adaption modules is assigned to one of the masking sound sources, wherein the assigned masking adaption module is configured to adapt the raw masking sound signal of the respective masking sound sources based on the analysis signal in order to produce one of the one or more masking sound signals.

5. The speech reproduction device according to claim 4, wherein the at least one masking sound source comprise a music source configured to provide a raw music masking sound signal, wherein the assigned masking adaption module is configured to adapt the raw music masking sound signal based on the analysis signal in order to produce one masking sound signal of the one or more masking sound signals.

6. The speech reproduction device according to claim 4, wherein the at least one masking sound source comprise a continuous noise source configured to provide a raw continuous noise masking sound signal, wherein the assigned masking adaption module is configured to adapt the raw continuous noise masking sound signal based on the analysis signal in order to produce one masking sound signal of the one or more masking sound signals.

7. The speech reproduction device according to claim 4, wherein the at least one masking sound source comprise a dynamic noise source configured to provide a raw dynamic noise masking sound signal, wherein the assigned masking adaption module is configured to adapt the raw dynamic noise masking sound signal based on the analysis signal in order to produce one masking sound signal of the one or more masking sound signals.

8. The speech reproduction device according to claim 1, wherein the audio processing module comprises an adaptive speech processing module configured to provide an adapted speech signal based on the speech signal, wherein the speech loudspeaker signal producer is configured to produce the one or more speech loudspeaker signals based on the adapted speech signal.

9. The speech reproduction device according to claim 1, wherein the audio processing module is configured to receive a setup signal comprising information regarding a setup of the set of speech loudspeakers and/or the setup of the set of masking sound loudspeakers.

10. The speech reproduction device according to claim 1, wherein the masking sound generator is configured to receive a weather signal comprising information regarding weather conditions and to produce the one or more masking sound signals based on the weather signal.

11. The speech reproduction device according to claim 1, wherein the masking sound generator is configured to receive a light signal comprising information regarding light conditions and to produce the one or more masking sound signals based on the light signal.

12. The speech reproduction device according to claim 1, wherein the masking sound generator is configured to receive a time signal comprising information regarding date and/or time and to produce the one or more masking sound signals based on the time signal.

13. The speech reproduction device according to claim 1, wherein the masking sound generator is configured to receive an engine signal comprising information regarding an operating parameter of an sound producing engine and to produce the one or more masking sound signals based on the engine signal.

14. The speech reproduction device according to claim 1, wherein the speech reproduction device comprises a tracking device configured for tracking a position and/or orientation of a person in the clear speech zone and/or for tracking a position and/or orientation of a person in the masked speech zone, wherein the tracking device is configured to produce a tracking signal comprising the position and/or orientation of the person in the clear speech zone and/or the position and/or orientation of the person in the masked speech zone, wherein the audio processing module is configured to receive the tracking signal and to produce the one or more masking sound loudspeaker signals based on the tracking signal.

15. The speech reproduction device according to claim 1, wherein the masking sound loudspeaker signal producer is configured to produce the masking sound loudspeaker signals in such way that the masking sound comprises the same spatial cues as the speech in the masked speech zone.

16. The speech reproduction device according to claim 1, wherein the speech reproduction device comprises one or more microphones assigned to the masked speech zone, wherein each of the microphones produces a microphone signal.

17. The speech reproduction device according to claim 15, wherein at least two microphone signals of the microphone signals are fed to the masking sound loudspeaker signal producer, and wherein the masking sound loudspeaker signal producer is configured to determine the spatial cues of the speech in the masked speech zone based on the at least two microphone signals.

18. The speech reproduction device according to claim 16, wherein at least one microphone signal of the microphone signals is fed to the masking sound generator, wherein the masking sound generator is configured to produce the one or more masking sound signals based on the at least one microphone signal.

19. The speech reproduction device according to claim 1, wherein the masking sound generator is configured to produce the one or more masking sound signals based on one or more room impulse responses and/or one or more transfer functions from the set of speech loudspeakers to the clear speech zone, based on one or more room impulse responses and/or one or more transfer functions from the set of masking sounds loudspeakers to the clear speech zone, based on one or more room impulse responses and/or one or more transfer functions from the set of speech loudspeakers to the masked speech zone and/or based on one or more room impulse responses and/or one or more transfers function from the set of masking sound loudspeakers to the masked speech zone.

20. A method for reproducing speech based on a received speech signal so that the reproduced speech is intelligible in a clear speech zone and unintelligible in a masked speech zone, the method comprising:

receiving the speech signal using an audio processing module;

reproducing the speech based on one or more speech loudspeaker signals using a set of speech loudspeakers;

producing a masking sound based on one or more masking sound loudspeaker signals using a set of masking sound loudspeakers, wherein the masking sound masks the speech in the masked speech zone;

producing the one or more speech loudspeaker signals based on the speech signal using a speech loudspeaker signal producer of the audio processing module;

producing one or more analysis signals based on spectral and/or temporal characteristics of the speech signal using a speech signal analysis module of the audio processing module;

producing one or more masking sound signals based on the one or more analysis signals using a masking sound generator of the audio processing module; and producing the one or more masking sound loudspeaker signals based on the one or more masking sound signals using a masking sound loudspeaker signal producer of the audio processing module.

21. A non-transitory digital storage medium having a computer program stored thereon to perform the method for reproducing speech based on a received speech signal so that the reproduced speech is intelligible in a clear speech zone and unintelligible in a masked speech zone, the method comprising:

receiving the speech signal using an audio processing module;

reproducing the speech based on one or more speech loudspeaker signals using a set of speech loudspeakers;

producing a masking sound based on one or more masking sound loudspeaker signals using a set of masking sound loudspeakers, wherein the masking sound masks the speech in the masked speech zone;

producing the one or more speech loudspeaker signals based on the speech signal using a speech loudspeaker signal producer of the audio processing module;

producing one or more analysis signals based on spectral and/or temporal characteristics of the speech signal using a speech signal analysis module of the audio processing module;

producing one or more masking sound signals based on the one or more analysis signals using a masking sound generator of the audio processing module; and producing the one or more masking sound loudspeaker signals based on the one or more masking sound signals using a masking sound loudspeaker signal producer of the audio processing module, when said computer program is run by a computer.

22. The speech reproduction device according to claim 1, wherein the one or more masking sound signals are specific for the spectral and/or the temporal characteristics of the speech signal.

23. The method of claim 20, wherein the one or more masking sound signals are specific for the spectral and/or the temporal characteristics of the speech signal.

24. The non-transitory digital storage medium of claim 21, wherein the one or more masking sound signals are specific for the spectral and/or the temporal characteristics of the speech signal.

* * * * *